US008556838B2

(12) United States Patent
Moutray

(10) Patent No.: US 8,556,838 B2
(45) Date of Patent: Oct. 15, 2013

(54) ERGONOMIC THERAPEUTIC MASSAGE DEVICE

(76) Inventor: Belinda Sue Moutray, Seattle, WA (US)

( * ) Notice: Subject to any disclaimer, the term of this patent is extended or adjusted under 35 U.S.C. 154(b) by 1680 days.

(21) Appl. No.: 11/781,215

(22) Filed: Jul. 20, 2007

(65) Prior Publication Data

US 2008/0027364 A1 Jan. 31, 2008

Related U.S. Application Data

(60) Provisional application No. 60/833,010, filed on Jul. 25, 2006.

(51) Int. Cl.
*A61H 7/00* (2006.01)
*A61H 39/04* (2006.01)

(52) U.S. Cl.
USPC ..... 601/134; 601/135

(58) Field of Classification Search
USPC ..... 601/134, 135, 136, 137; 606/204; D24/200, 211, 214
See application file for complete search history.

(56) References Cited

U.S. PATENT DOCUMENTS

| | | | | | |
|---|---|---|---|---|---|
| D277,983 | S | * | 3/1985 | Kaminski | D24/214 |
| D375,167 | S | * | 10/1996 | Taylor | D24/214 |
| 5,817,037 | A | * | 10/1998 | Zurbay | 601/135 |
| 5,843,005 | A | * | 12/1998 | Chubinsky | 601/15 |
| 2006/0155225 | A1 | * | 7/2006 | Murdock et al. | 601/131 |

* cited by examiner

*Primary Examiner* — Quang D Thanh

(57) ABSTRACT

An ergonomic and therapeutic massage device having improved ergonomics which reduces operator fatigue and discomfort while maximizing the experience of the massage provides a penetrating massage that effectively stimulates soft tissue structures, neural receptors and acupressure points, quickly providing pain and stress relief without exertion on the part of the operator. The device has a unique shape and is comprised of a top bulb-shaped portion and a bottom disc-shaped portion. The device is generally molded from solid glass.

1 Claim, 2 Drawing Sheets

ERGONOMIC THERAPEUTIC MASSAGE DEVICE

CROSS REFERENCE TO RELATED APPLICATIONS

This application claims the benefit of U.S. Patent Application 60/833,010 filed in the United States Patent and Trademark Office on Jul. 25, 2006.

FIELD OF THE INVENTION

This application discloses a device for body massage and in particular an ergonomic therapeutic massage device.

BACKGROUND OF TEE INVENTION

Massage is the physiologically and psychologically therapeutic manipulation of muscles, tendons, ligaments and cartilage, with the additional rejuvenating effect upon the skin. Injuries, repetitive stress injuries, mental stress, illness and anxiety all increase muscle tension. Muscle tension increases lactic acid, constricts capillaries within the muscles, and consequentially restricts the blood and oxygen circulation. The purpose of deep massage, beyond relaxation, is to maintain mobility within the soft tissue structures, increase blood and oxygen circulation while releasing toxins and wastes from the muscles, and to break down and/or prevent scar tissue from forming. It is well accepted today that early motion of injured tissue results in repair with reduced scar tissue formation or more improved alignment of the fibrosis and the soft tissue structure. In the early stages of healing, scar tissue is not as strong as in later stages, and it is thought that the remodeling phase of the inflammatory response depends on mechanical stimuli. The skin's neural receptors react to various stimuli including pressure and they convert this pressure into electrical impulses. It is believed that stimulating an acupoint, which generates considerably more electromagnetic energy, causes the release of opiates known as endorphins within the brain. Endorphins are a completely natural substance of which two major types, enkephalins and dynorphins are both distributed throughout the nervous system. When endorphins bind to opiate receptor neurons, they reduce the intensity of pain in the human body by blocking pain signals produced by the nervous system. Recent studies suggest that endorphins enhance the immune system, relieve pain, reduce stress and retard the aging process. The physiological result of the endorphin release mechanism is one of deep relaxation respiration slows down, heart rate decreases, blood is shunted from the extremities to the body's core, which improves digestion and venous flow to the internal organs. The lymphatic system speeds up, increasing the rate of excretion of waste and toxins from the body. Besides behaving as a pain regulator, endorphins are also thought to be connected to physiological processes including euphoric feeling, appetite modulation, and the release of sex hormones.

There are many devices that are used for body massage. Examples can be found in the following U.S. Pat. Nos. 7,159,120; D693,064; 6,245,031; D415,569; D349,576; D272,090; and, 7,137,960. What these devices lack is an ergonomic design. These devices causes greater stress to the operator's fingers, thumbs, hands, wrists and arms; affecting muscles, soft tissue, joints and tendons and causing pain. Longevity of massage is less likely, certainly for the non-professional masseuse and can cause long term health issues for a massage practitioner.

Another shortcoming of these devices is that they are made of wood or other absorbing materials and they are manufactured from conjoined pieces. After continued use these devices become unhygienic due to the presence of human skin particles and the absorption of natural and synthetic oils and lotions.

Another shortcoming with these devices is that they are made from materials with less than optimal density, weight, hardness and thermal conductivity and so are inferior tools for use in the healing arts.

A further shortcoming is that that most massage devices are not aesthetically pleasing, indiscreet, easily portable or adapted to self-massage.

Therefore, what is required is a massage device with improved ergonomic design for the operator, made from a hygienic material having optimal massage characteristics.

DETAILED DESCRIPTION OF ONE EXAMPLE OF MY MASSAGE DEVICE

Figure 1:
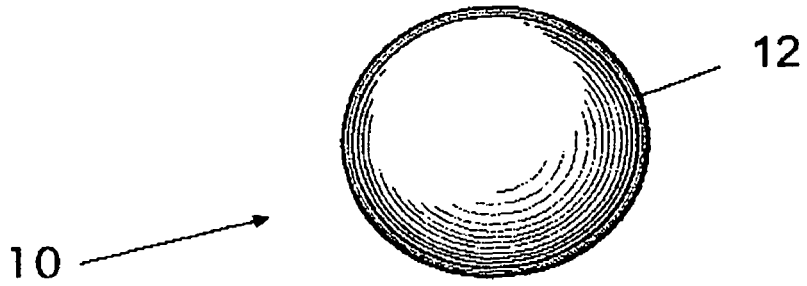
FIG. 1 is a top view of my massage device.

My massage device is an ergonomic therapeutic massage device that maximizes productivity of massage by reducing operator fatigue and discomfort and to provide a gliding, penetrating massage that easily stimulates soft tissue structures, neural receptors and acupressure points faster and quickly releases endorphins as a result.

In one example of my massage device there is provided a massage device that has an improved ergonomic design and improved thermal conductivity, hygiene, portability, and discreetness as well as being aesthetically pleasing.

Referring now to FIGS. 1 to 5, this example of my massage device comprises a solid body (10) having a top portion (12) and a bottom portion (14). The bottom portion (14) is adapted primarily for hand (16) gripping and comprises a toxoid-shaped gripping disc (18). The gripping disc (18) has a flat base (20) surface adapted to fit the palm (22) of the hand (16) and a curved portion (26) around which the fingers (28) and the thumb (29) of the hand are curled. The top surface (30) of the gripping disc (18) is integral to the top portion (12) of the body (10) and includes a shoulder (32) and a neck (34) also adapted for finger placement. The surface (36) of the gripping disc (18) is smooth and non-porous and provides sufficient frictional contact with the skin of the hand so that there is no slippage when applying pressure or torque to the gripping disc. The size of the gripping disc can be varied to suit a variety of hand sizes.

Figure 2:
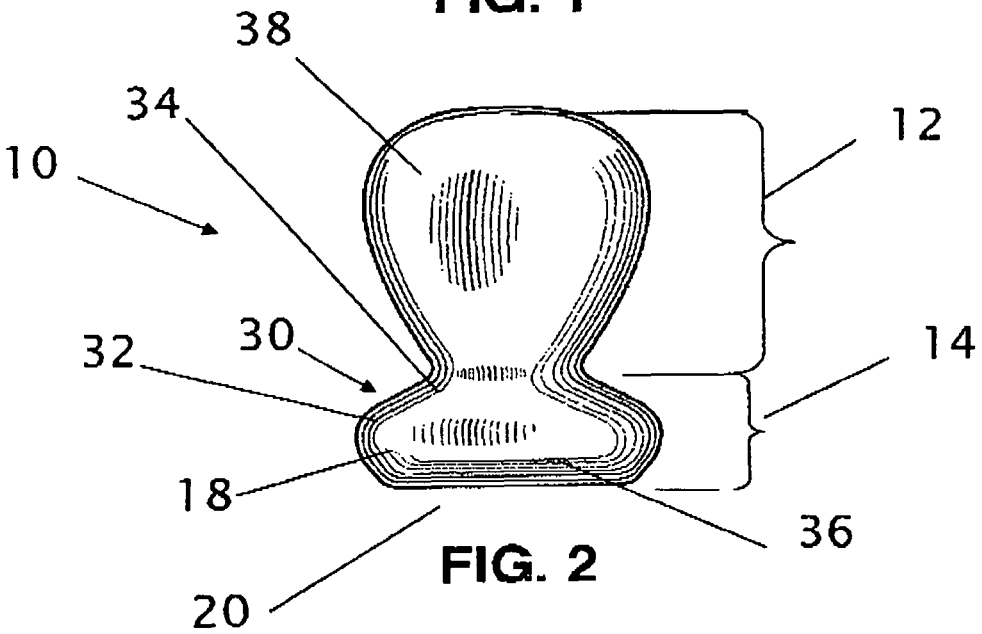
FIG. 2 is a side view of my massage device.
Figure 3:
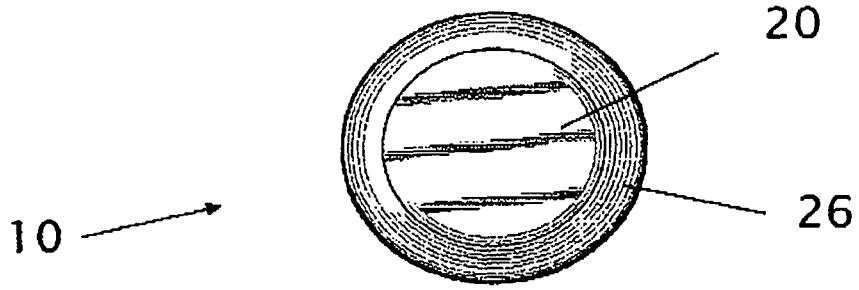
FIG. 3 is a bottom view of my massage device.
Figure 4:
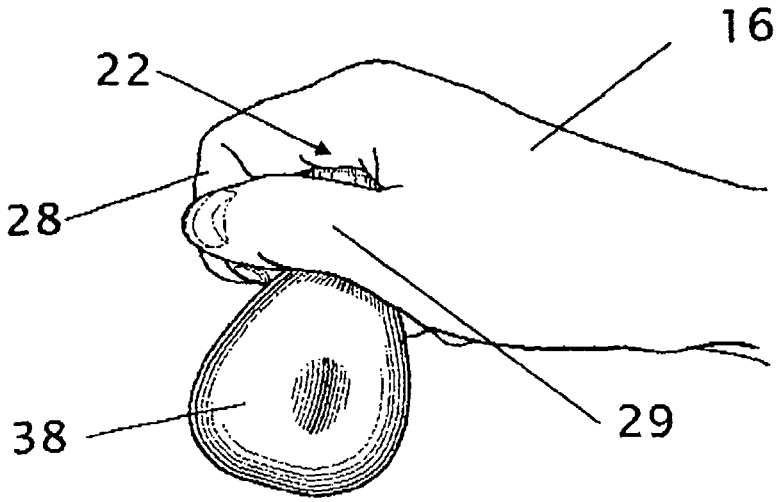
FIG. 4 illustrates one way of utilizing my massage device.
Figure 5:
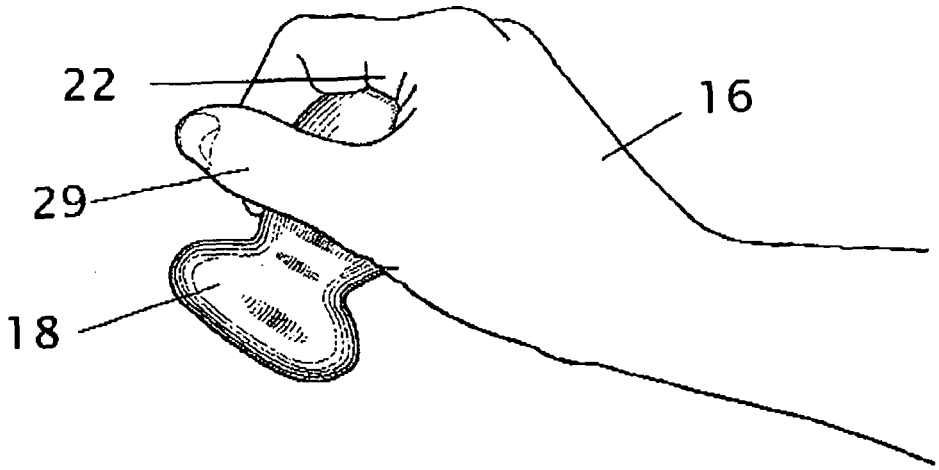
FIG. 5 illustrates another way of utilizing my massage device.

In the example shown in FIG. 2, the top portion (12) of the massage device (10) comprises a pressure application bulb (38) in the shape of an inverted and truncated pear. While the bulb (38) is used primarily for applying pressure to a surface, it can also be used as a band grip when performing certain massage techniques as illustrated in FIG. 5. The combined bulb and disc grip forming the body (10) are well suited to applying rotational, stroking, tapping and pressing motions used in massage therapy while at the same time sparing the hand and wrist of the hand from undue stress and strain.

In the example illustrated, the massage device is manufactured from glass having a Mohs hardness of about 6 to 6.5 and a density of about 2.5 g/cc. The density is sufficiently high so that the mass of the massage device takes advantage of gravity in applying the therapeutic forces to the surface of the body being massaged. In other examples of my massage device these physical characteristics may be varied. Glass is thermally conductive and so well suited for warm and cold massage techniques.

In other examples of my invention, tire body may be manufactured from stone, metal or ceramic materials of sufficient density to provide the necessary pressure for effective massage therapy. The materials use must also be capable of be worked into the necessary shape described in FIG. 2.

The massage device is manufactured using a molten glass molding technique to ensure a consistent shape. The device is molded as a single piece. During the molding process air bubbles can be entrained in the molten glass to create an, object that is attractive. Glass of a wide variety of colors can be used. This material is very hygienic and easily sterilized.

Although only a few examples of my massage device are described in this specification those skilled in the art will understand that modifications and variations may be made and that such modifications and variations are considered to be within the purview and scope of my massage device.

I claim:

1. A hand-held massage device for applying therapeutic forces to a human body, said hand-held massage device comprising:

a solid one-piece body comprising a top portion and a bottom portion;

said top portion comprising a hand-grasping bulb having an inverted and truncated pear shape for applying said therapeutic forces, said bulb including a top end portion having a diameter that is larger than a diameter of a tapered end portion; and said bottom portion comprising a hand-grasping circular disc having a top surface that is integral to said tapered end portion of said bulb of said top portion of said body, said top surface including a shoulder and a concave neck connecting to said tapered end portion of said bulb, and said disc further including a flat bottom surface for applying said therapeutic forces.

* * * * *